US005918381A

United States Patent [19]

Landry

[11] Patent Number: 5,918,381

[45] Date of Patent: Jul. 6, 1999

[54] SHOE SOLE WITH LIQUID-POWERED VENTILATING FANS

[76] Inventor: Norman Landry, P.O. Box 3225, Boise, Id. 83701

[21] Appl. No.: 09/069,107

[22] Filed: Apr. 28, 1998

Related U.S. Application Data

[60] Provisional application No. 60/048,800, Jun. 6, 1997.

[51] Int. Cl.[6] ..... A43B 7/06

[52] U.S. Cl. ..... 36/3 B; 36/3 R

[58] Field of Search ..... 36/3 R, 3 B, 3 A, 36/28, 29, 141, 2.6

[56] References Cited

U.S. PATENT DOCUMENTS

| | | | |
|---|---|---|---|
| 3,273,264 | 9/1966 | Farinello, Jr. | 36/3 R |
| 4,782,602 | 11/1988 | Lakic | 36/2.6 |
| 5,295,313 | 3/1994 | Lee | 36/3 R |
| 5,375,345 | 12/1994 | Djuric | 36/3 R |
| 5,384,977 | 1/1995 | Chee | 36/28 |
| 5,401,039 | 3/1995 | Wolf | 280/11.22 |

OTHER PUBLICATIONS

Drake, John. "Shirt–Button Turbines", *MIT Reporter* (Jan./Feb., 1998), pp. 10–11.

*Primary Examiner*—M. D. Patterson
*Attorney, Agent, or Firm*—Ken J. Pedersen; Barbara S. Pedersen

[57] ABSTRACT

This invention relates to a product built into the sole of a shoe that will cool and dehumidify one's feet, providing superior comfort to the feet of the person wearing the shoe. The invention comprises two layers, one of which has a liquid-filled area with a liquid powered turbine and the other layer containing a built-in air fan or fans or other turbines which are powered by the liquid turbine responding to the liquid movement in the other layer. These two layers are molded or otherwise connected to a shoe sole.

6 Claims, 7 Drawing Sheets

SHOE SOLE WITH LIQUID-POWERED VENTILATING FANS

DESCRIPTION

This application is a conversion of, a continuation-in-part of, and claims priority from, prior pending provisional application Ser. No. 60/048,800 filed on Jun. 6, 1997 with the same title.

BACKGROUND OF THE INVENTION

1. Field of the Invention

This invention relates to a product built into the sole of a shoe that will cool and dehumidify one's feet, providing superior comfort to the feet of the person wearing the shoe. Specifically, the invention comprises two layers, one of which has a liquid-filled area with a liquid powered turbine and the other layer containing a built-in air fan or fans or other turbines which are powered by the liquid turbine responding to the liquid movement in the other layer. These two layers are molded or otherwise connected to a shoe sole.

2. Related Art

Shoes have been developed with compressible air-sac or air bellows (refer U.S. Pat. No. 5,295,313 to Lee, issued Mar. 22, 1994 and U.S. Pat. No. 5,375,345 to Djuric, issued Dec. 27, 1994), battery-powered fan (U.S. Pat. No. 3,273, 264 to Farinello, issued Jan. 10, 1964), or in-line-skate-wheel-powered fans to circulate air (U.S. Pat. No. 5,401,039 to Wolf, issued Mar. 28, 1995). Also, shoes have been developed with liquid-filled areas in the heel of a shoe to provide shock resistance.

What is still needed is a shoe sole that provides for many types of foot comfort, by cushioning, ventilating, cooling or heating, and dehumidifying.

SUMMARY OF THE INVENTION

The invention comprises various embodiments of a liquid-powered, air-cooled shoe referred to as "Turbo Shoe". The shoe has at least two layers as part of its sole. Within a first lower layer, for example, is a pad devised of a durable, flexible one-piece material (to be made available in accordance to shoe sizes) which has fluid-filled internal spaces, between which will be sealed a turbine. The internal spaces will be charged with a non-toxic, liquid anti-freeze or other safe fluid, including sol or gel. Foot movement as the user walks or runs will put pressure on the liquid and make it flow, typically from back to front, and then to back again, the movement of which will cause the turbine to turn. This turbine is mechanically or operatively connected to one or more fans in a second (upper) layer, by such means as shafts and gearing, or by magnetic interaction.

This other layer is the air layer, and comprises a network of preferably rigid or semi-collapsible air tubes operatively connected to one or more air fans. The mechanical movement of the liquid turbine forces the air fan(s) to force the air through air channels in the air layer into and, optionally, out of the shoe's upper area around the foot. The mechanical or magnetic gearing of all the turbines controls the direction of air movement. The used, "contaminated" ventilating and dehumidifying air exits the shoe either directly from the foot area from the shoe top, or by flowing from the foot area back into the air layer of the sole via an exhaust tube system and then out to atmosphere. The fans, driving mechanisms, and fluid ducts may be configured to drive air in either direction, either pushing or pulling fresh and/or heated or cooled air into the foot area and similarly pushing or pulling contaminated air out of the foot area.

Similarly, the layers may be otherwise configured. The layers could be reversed so that the fluid-compression layer is on top to better use the direct mechanical action of the moving foot, and the air-propulsion layer could be the lower level with air ducts passing through the fluid layer and into the foot area. Conceivably, the two compartments could also be arranged side by side. In any configuration, however, the two operative layers are attached to each other and are affixed to the sole of a shoe. The result is maximum foot comfort due to the cushioning and liquid exchange from back to front or front to back of the shoe caused by the pressure of foot movement, plus the air movement which enhances foot coolness and which may dehumidify the foot.

DESCRIPTION OF THE PREFERRED EMBODIMENTS

Figure 1:
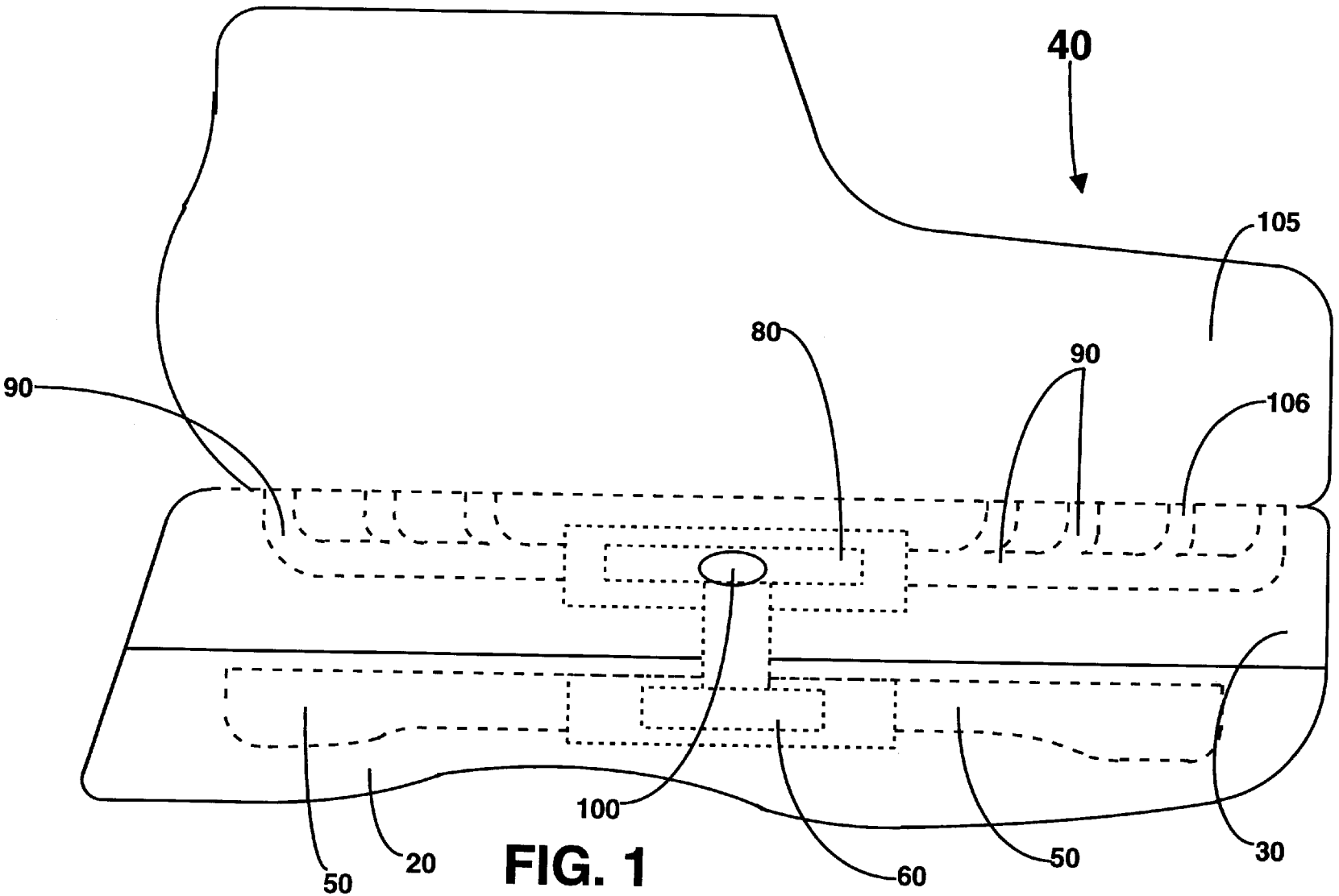
FIG. 1 is a schematic side view of one embodiment of the invented "Turbo Shoe" showing the two layers, A, B, molded into the sole of the shoe.
Figure 2:
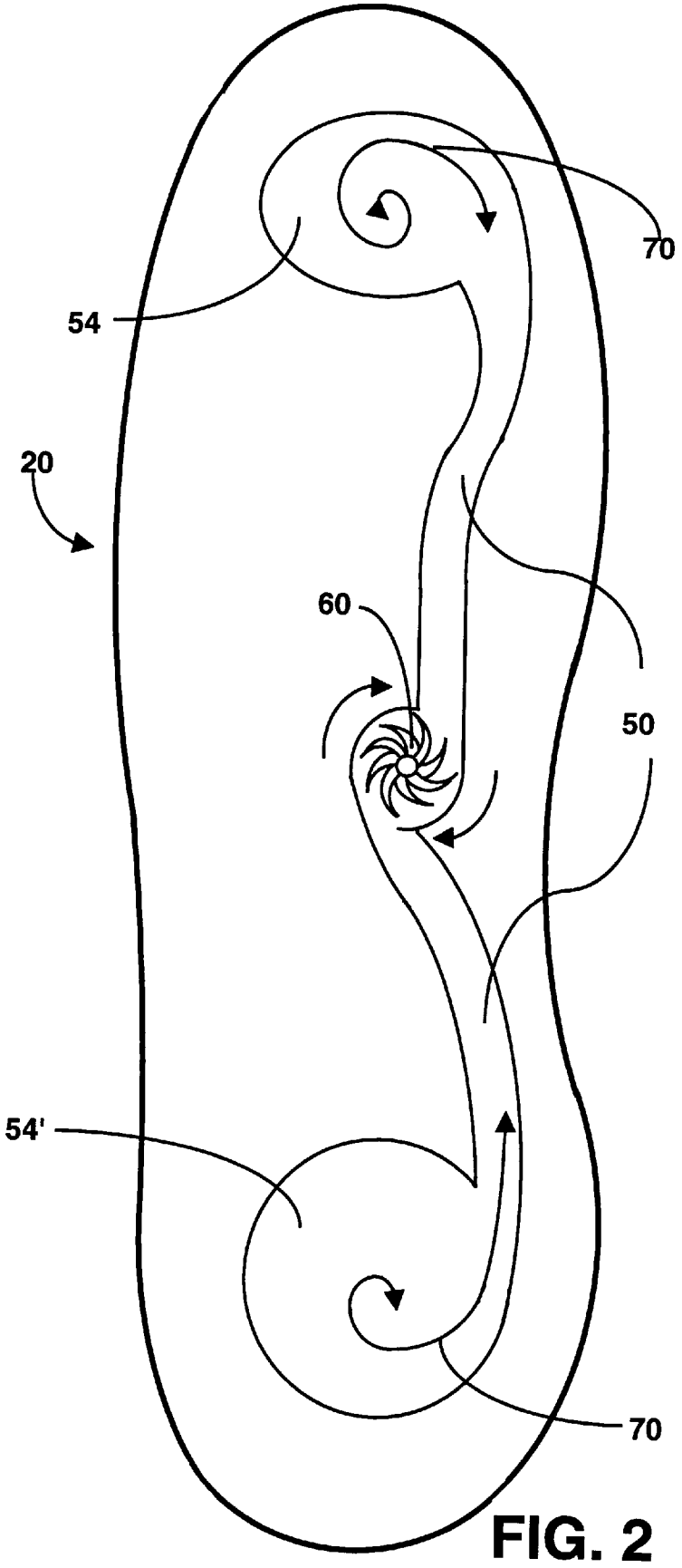
FIG. 2 is a schematic top view of the sole layer A, or "liquid layer" of the "Turbo Shoe".
Figure 3:
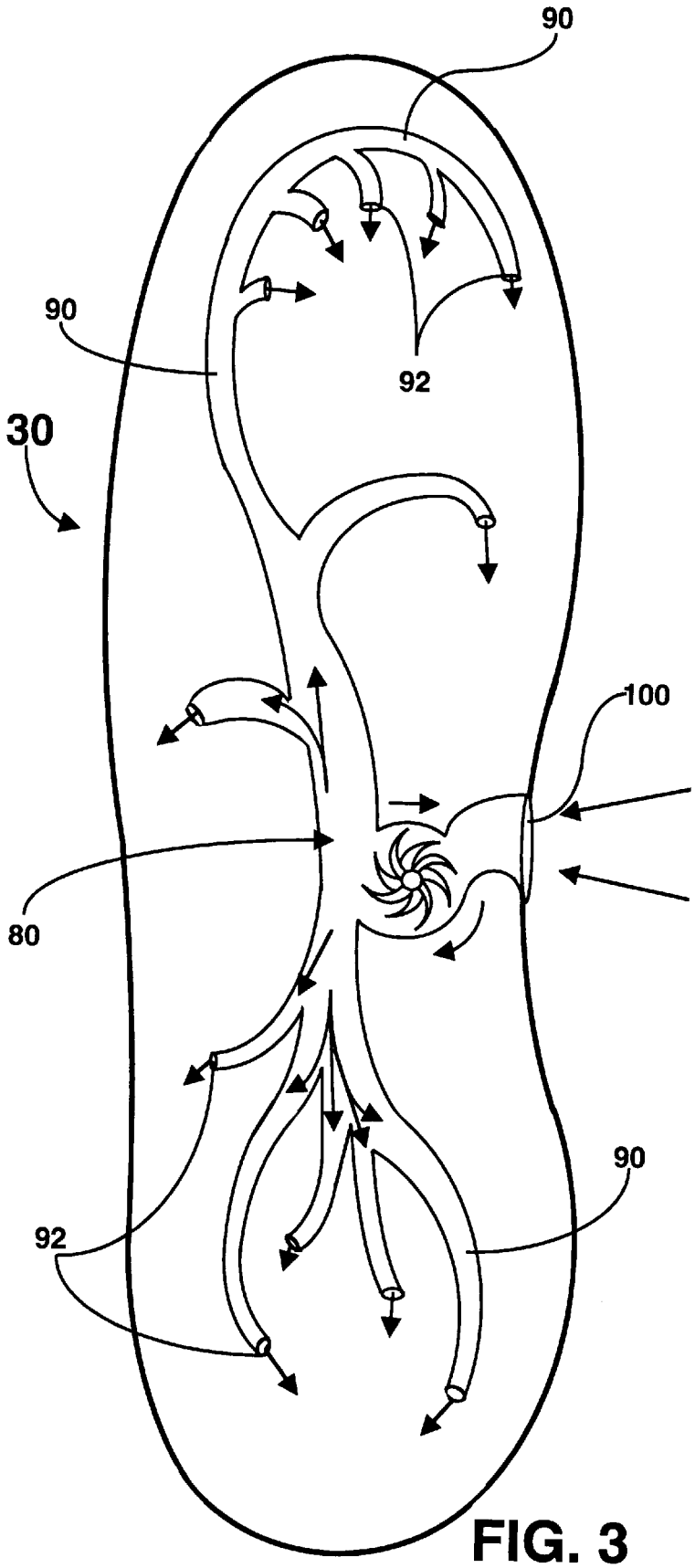
FIG. 3 is a schematic top view of the sole layer B, or "air layer", of the "Turbo Shoe".

Demonstrated in FIGS. 1–11 are some, but not the only, embodiments and methods which make the "Turbo Shoe" work. FIG. 1 shows the two sole layers, attached or built-in to the shoe 40: lower layer 20 designated in this discussion as "layer A" and an upper layer 30 or "layer B". These layers are attached or built-in to the sole of the shoe 40, and may be included with other layers as appropriate for shoe or boot construction. The layers are designated "upper" for air movement functions and "lower" for liquid movement functions throughout this document for the sole purpose of clarity and not necessarily as a limitation; the "layers" as compartments could be configured in a variety of places and manners as discussed above.

The bottom layer A 20 is the "liquid layer" which serves as the power source for the air fans or other air turbines encased in the upper layer 30. This bottom layer 20 ("layer A") comprises preferably a one-piece, flexible, durable, puncture-resistant material forming a pad with liquid channels 50, which include reservoir areas 54, 54', shown in FIG. 2, sized to accommodate various shoe sizes. Inside the channels 50 will be sealed a turbine 60. The liquid channels 50 will be charged with a liquid, non-toxic, anti-freeze type material that can flow between the reservoirs 54, 54'. The enclosed turbine 60 is activated by foot pressures upon the encased liquid which is in the liquid channels 50. The movement of the encased liquid from rear to front of the channel 50 area, that is, from reservoir 54' toward the turbine 60 causes the turbine to turn. The movement 70 and the compressibility and cushioning of the liquid-filled layer A 20, in turn, would provide a comfortable base for the foot.

The upper layer 30 (layer B) of the embodiment is the "air layer" which provides the means by which the foot is cooled or heated and dehumidified. As explained in FIG. 3, a fresh air turbine 80 is centrally located in this layer 30, with a system of rigid or semi-collapsible tube channels 90 emitting from it and extending around the sole layer. The fresh air intake tube 100 leading to this turbine 80 will be sewn into the upper shoe collar so that outside air can be drawn into the air channels 90 of layer A. Air from the outlets 92 of the tubes 90 goes via holes 106 into the upper region 105 of the shoe which receives the foot. Alternatively, it would be possible to have air intake funneled into the shoe via intake tube 100 from warmer areas of the body in the case of footwear designed for colder conditions.

Figure 4:
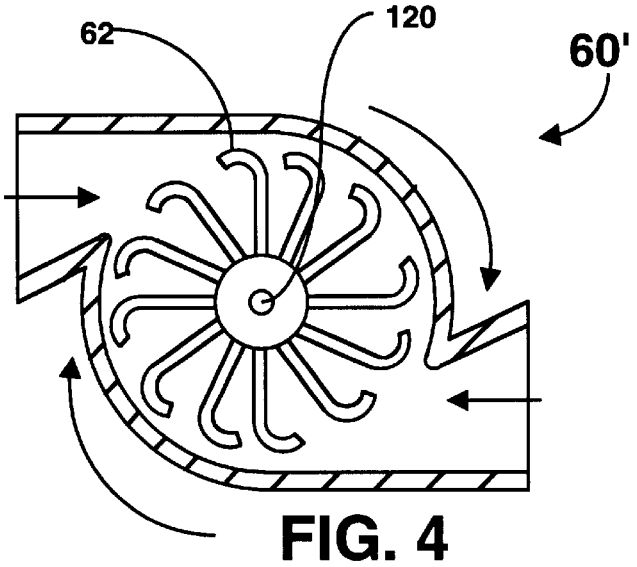
FIG. 4 shows an embodiment of the "turbo Shoe" liquid-powered turbine, such as shown in layer A of FIG. 2, shown as an enlarged, side, cross-sectional view.
Figure 5:
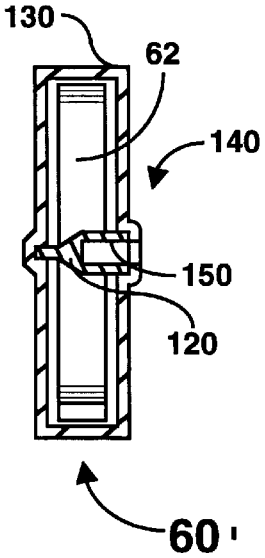
FIG. 5 is an enlarged, cross-sectional end view of the liquid turbine, where the shaft and seal for attachment to the air fan device (depicted in FIG. 7) are shown.

An embodiment of a liquid-powered turbine 60' is shown in FIG. 4 as an enlarged top cut view. It preferably comprises a durable one-piece plastic turbine fan and a shaft 120, as pictured in FIG. 5, which has a two-piece outer casing 130 with a single seal 140 for preventing liquid leakage and a drive shaft connection area 150.

Figure 6:
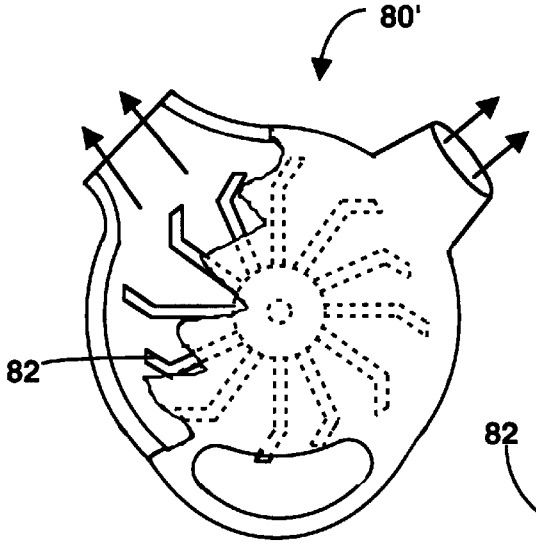
FIG. 6 is a top, partly cross-sectional view of the air fan system which provides the air flow to the foot of the person wearing the "Turbo Shoe".
Figure 7:
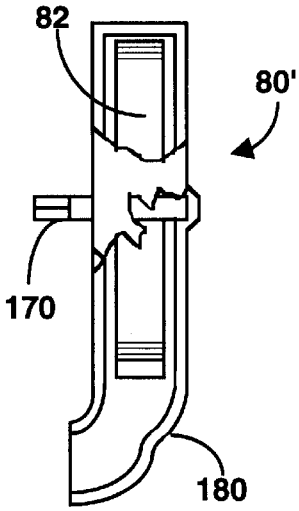
FIG. 7 gives an enlarged side view of the air fan of FIG. 6, with an arrow showing its connection to the liquid turbine.

Similarly, as shown via a top view in FIG. 6, the air turbine 80' is also constructed of a one-piece plastic turbine fan 82 and, as shown in FIG. 7, has a shaft 170, with a split two-piece outer casing 180. This air turbine unit 80' mechanically and operatively connects to the liquid turbine 60' via shaft 170.

Ultimately, the bottom sole layer 20 (FIG. 1) is attached to the upper sole layer 30 (FIG. 1), with the drive stem or shaft 170 from the air turbine 80, 80' inserted into the liquid turbine 60, 60' during the attachment process. This creates a mechanical attachment of liquid turbine 60, 60' to air fan or turbine 80, 80', linking the two so that the liquid turbine in FIG. 2 drives the air fan or turbine in FIG. 3.

Figure 8:
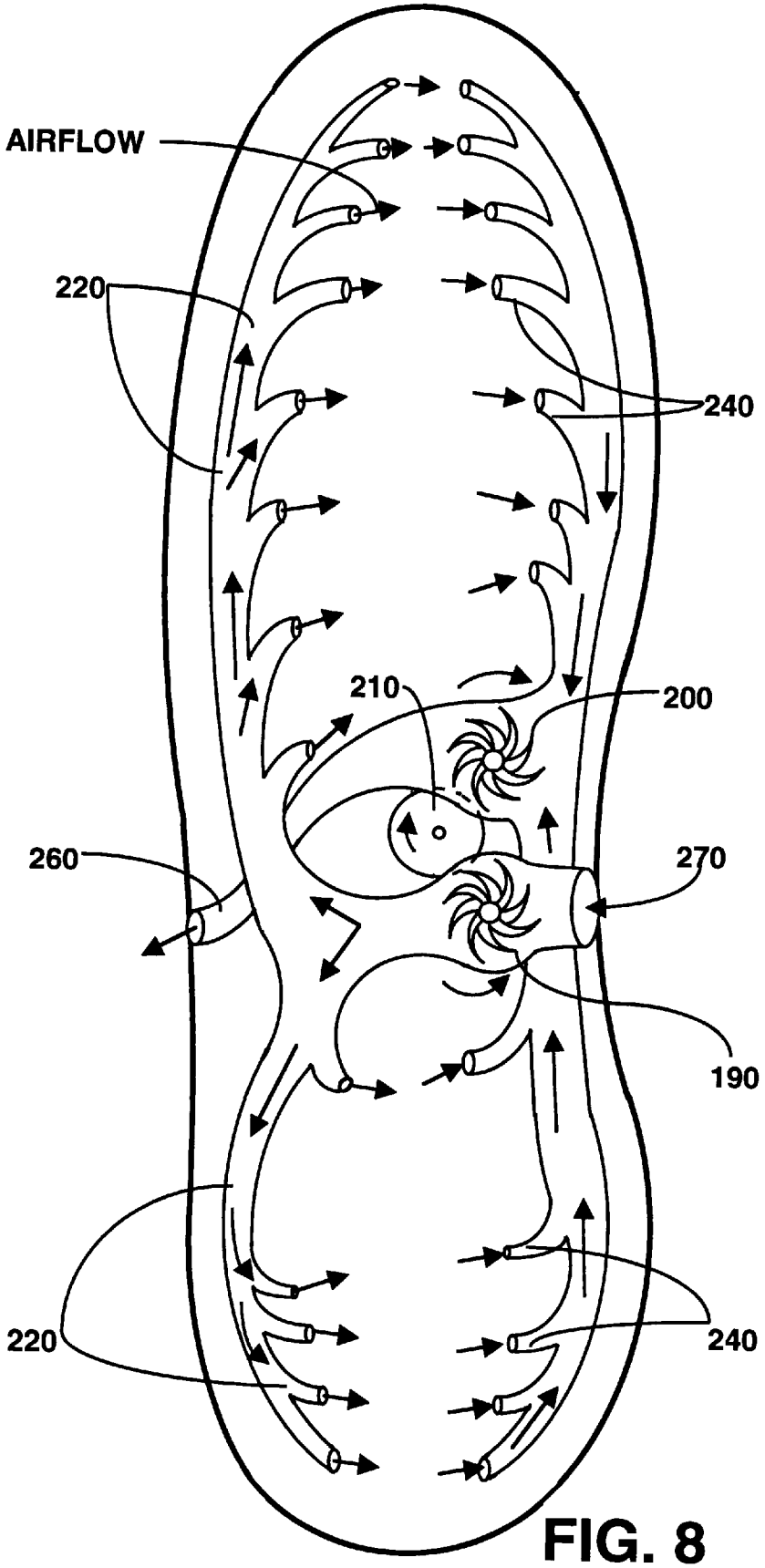
FIG. 8 demonstrates, via a schematic top view of layer B, with the liquid turbine shown below the air fans, how a double air-fan system looks.

An additional embodiment is depicted in FIG. 8, whereby two fans 190 and 200 are situated in the air layer. The two fans 190 and 200 are connected to a single turbine 210 in the liquid layer and function in a similar manner as with a single fan in the air layer.

The fan 190 and ventilation air tubes 220 in FIG. 8 send air to the wearer's foot, and the exhaust fan 200 pulls air from the foot area 105, via the exhaust tubes 240, and sends it out to the atmosphere, via exhaust outlet 260.

Figure 9:
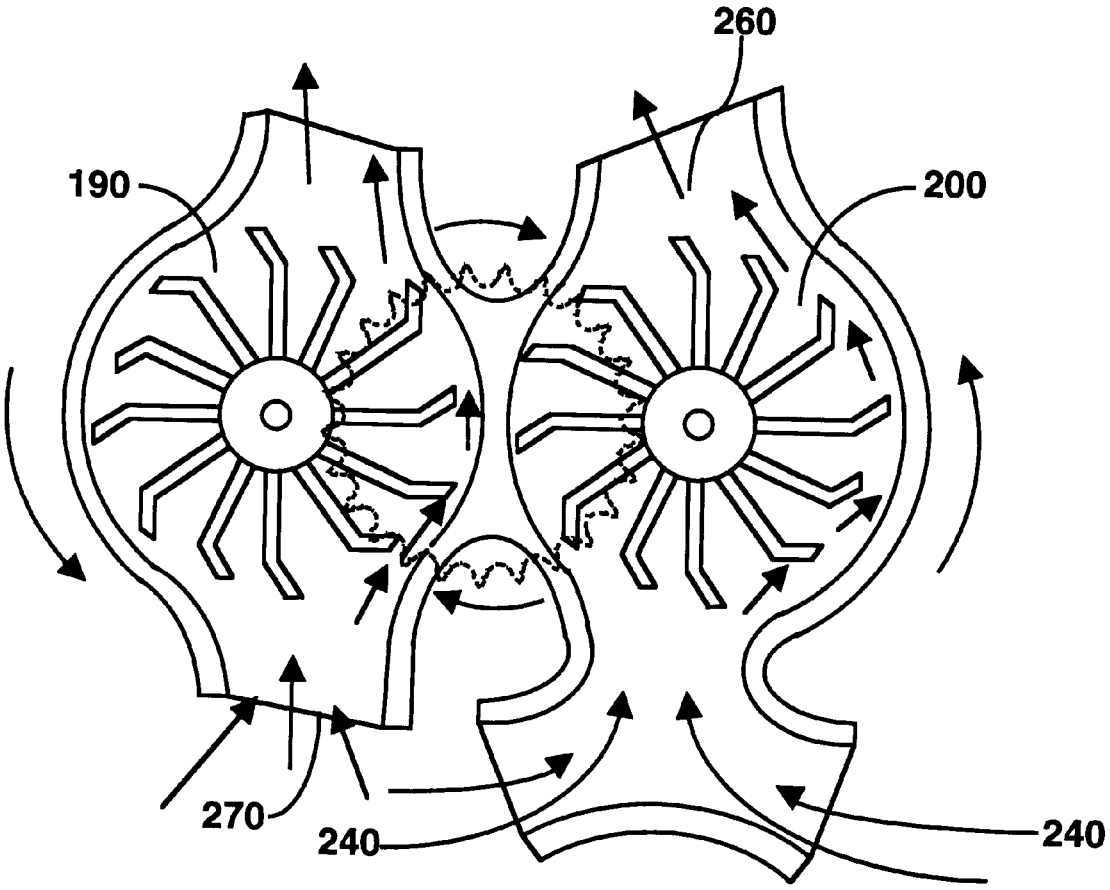
FIG. 9 is a top view (enlarged scale of approximately 2×) of the intake and exhaust patterns of the fans of FIG. 8 with the liquid turbine shown below, demonstrating their movement.

FIG. 9 shows an enlarged cut-view depicting the rotational movement of the two air fans 190 and 200 working together powered by turbine 210 and showing the flow of air from intake 270 to exhaust 260.

Figure 10:
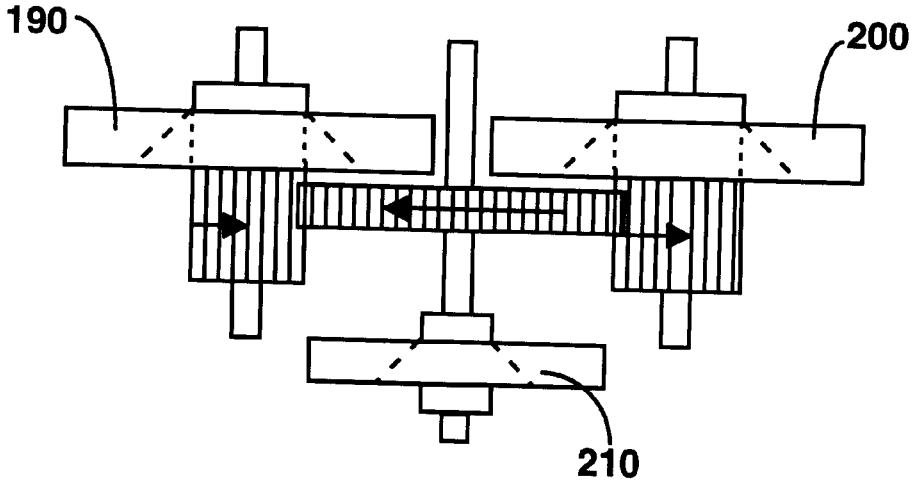
FIG. 10 shows a schematic side view of the FIG. 9 embodiment of the three turbine system (i.e., a liquid turbine and two air fans) and the construction of the required increased gearing ratio (without any housing).

FIG. 10 provides the side view of the linkage and increased gearing ratio when three turbines (2 air, 1 liquid) are used. This gearing ensures a constant directional flow of air from intake through to exhaust as the air moves through the fans.

Figure 11:
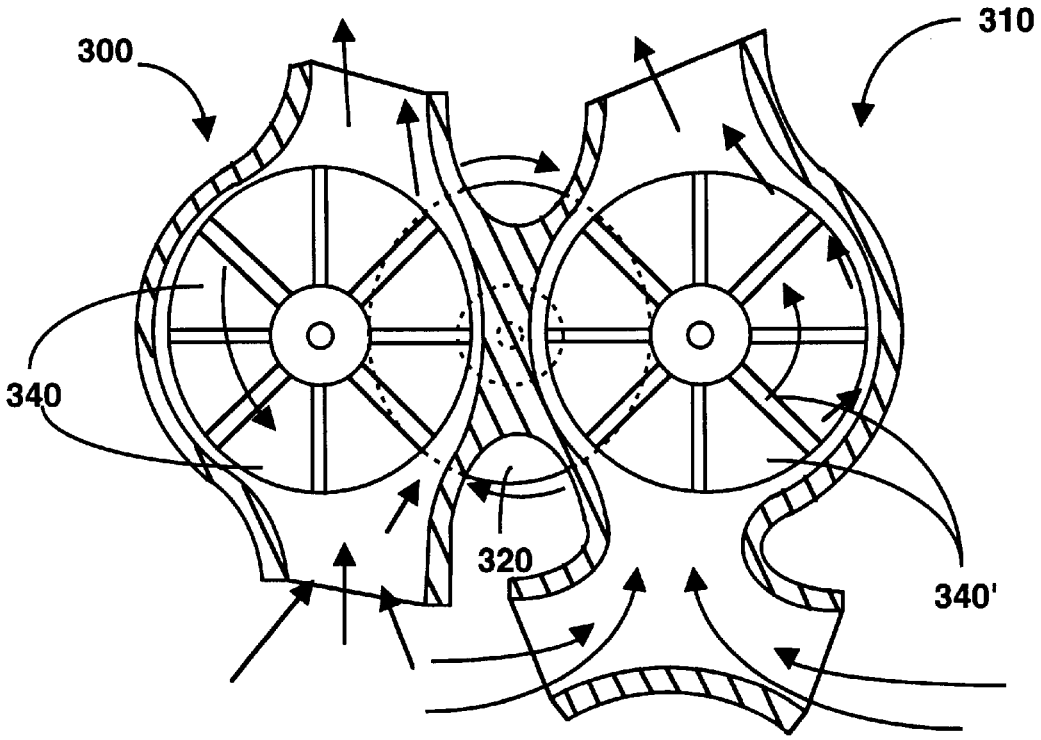
FIG. 11 shows an alternative embodiment of the three turbine system using a magnetic-drive system.
Figure 12:
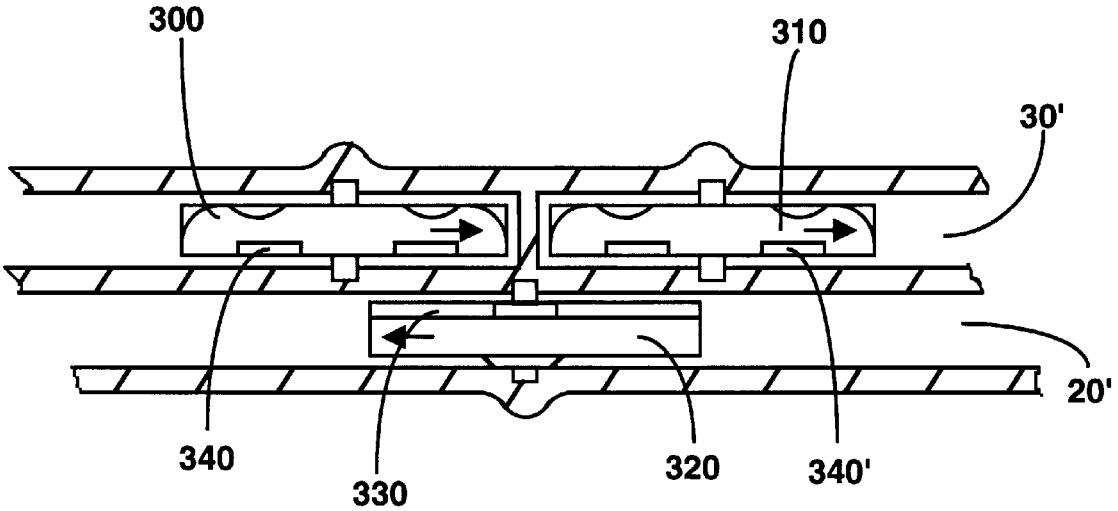
FIG. 12 shows a side view of the embodiment depicted in FIG. 11.

FIGS. 11 and 12 illustrate an alternative system for driving air fans 300 and 310 in an air layer 30'. Liquid turbine 320 in liquid layer 20' has magnets or other magnetic areas 330 on or near its preferably-disk-like top surface, which drive the air fans 300 and 310 by magnetically interacting with magnets or magnetic areas 340, 340' on or near the air fans preferably-disk-like bottom surfaces, for example. Such a magnetic-based system may allow the liquid and air layers to be sealed from each other. This is done by eliminating the need for shafts extending between the liquid and air layers, eliminating the need for liquid-seals around or near the shafts to prevent liquid or air from leaking between layers. The positioning of the magnets of the liquid and air turbines, preferably around or near the outer circumferences of the disk-like turbine surfaces, may be set to control the increase in gearing. Also, there is expected to be produced a sling shot effect from the pull of the magnets of the two air turbines trying to catch up to the rotation of the liquid-powered turbine magnets. Thus, a high rpm exchange to the air turbines from the liquid-powered turbine is created. Similarly, the "upper" turbines might be used for other purposes than moving air, like, for example, generating small amounts of electricity. Conversely, it is possible the air turbines could be used in another application to impart momentum to another or "lower" turbine.

Although this invention has been described above with reference to particular means, materials and embodiments, it is to be understood that the invention is not limited to these disclosed particulars, but extends instead to all equivalents within the broad scope of the disclosure.

What is claimed is:

1. A shoe sole, comprising:

a top air ventilation section with holes in the top surface of the top section of the sole, said holes being in fluid communication with a hole in a side of the sole top section, and an air fan located in said top section, said air fan being in fluid communication with the hole in a side and in fluid communication with the holes in the top of said sole top section;

a bottom fluid power section connected to said sole top section, said sole bottom section having a closed fluid power circuit comprising a front reservoir and front channel located near the front of said sole bottom section and a back reservoir and back channel located near the back of said sole bottom section, said front and back channels being connected to said front and back reservoirs, respectively, and said front and back channels being located nearer the center of said sole bottom section than said front and back reservoirs, and a fluid power turbine located between and in fluid communication with said front channel and said back channel; and drive means connecting said fluid power turbine to said air fan;

wherein stepping on the front of the shoe sole will cause the wearer's toes and ball of foot to compress the front reservoir and drive fluid through the front channel, fluid power turbine and through the back channel to the back reservoir and, alternatively, stepping on the back of the shoe sole will cause the wearer's heel to compress the back reservoir and drive fluid through the back channel, fluid power turbine and through the front channel to the front reservoir, thereby driving the air fan.

2. A shoe sole as defined in claim 1, wherein said air fan is adapted to draw fresh outside air into said hole in a side of the top section of the sole and to propel said outside air through said holes in the top surface of the top section of the sole.

3. A shoe sole as defined in claim 1, wherein said air fan is adapted to draw stale inside air into said holes in the top surface of the top section of the sole and to propel said inside air through said hole in a side of the top section of the sole.

4. A shoe sole as defined in claim 1, wherein said air fan is driven by said fluid power turbine by a drive shaft which connects the turbine to the fan.

5. A shoe sole as defined in claim 1, wherein said air fan is driven by said fluid power turbine by magnets combined with said fluid power turbine which interact with a magnetic material combined with the fan.

6. A shoe sole, comprising:

a first, fluid power collection section having a closed fluid power circuit comprising a front reservoir and front channel located near the front of said sole section and a back reservoir and back channel located near the back of said sole section, said front and back channels being connected to said front and back reservoirs, respectively, and said front and back channels being located between said front and back reservoirs, and a first rotating member comprising a fluid power collection turbine located between, and in fluid communication with, said front channel and said back channel;

a second, power distribution section comprising a second rotating member comprising a power distribution shaft; and drive means connecting said first rotating member to said second rotating member;

wherein stepping on the front of the shoe sole will cause the wearer's toes and ball of foot to compress the front reservoir and drive fluid through the front channel, through the first rotating member, the fluid power collection turbine, and through the back channel to the back reservoir and, alternatively, stepping on the back of the shoe sole will cause the wearer's heel to compress the back reservoir and drive fluid through the back channel, again through the first rotating member, and through the front channel to the front reservoir, thereby imparting angular momentum to the second rotating member, the power distribution shaft.

* * * * *